US005603141A

United States Patent [19]

Gledhill

[11] Patent Number: 5,603,141

[45] Date of Patent: Feb. 18, 1997

[54] INTERCHANGEABLE DOORSTOP

[75] Inventor: Dale C. Gledhill, Salt Lake City, Utah

[73] Assignee: Dynatec International, Inc., Salt Lake City, Utah

[21] Appl. No.: 508,590

[22] Filed: Jul. 28, 1995

[51] Int. Cl.[6] ..... E05F 5/06

[52] U.S. Cl. ..... 16/86 A

[58] Field of Search ..... 16/86 A, 86 R, 16/DIG. 17; 292/DIG. 15, 341.12

[56] References Cited

U.S. PATENT DOCUMENTS

| | | | |
|---|---|---|---|
| 2,899,703 | 8/1959 | Johnson | 16/86 A |
| 3,050,770 | 8/1962 | Morse et al. | 16/86 A |
| 3,362,040 | 1/1968 | Gurzenda | 16/86 A |
| 3,484,891 | 12/1969 | Borgen | 16/86 A |
| 3,969,786 | 7/1976 | Peak | 16/86 A |
| 3,994,043 | 11/1976 | Gurzenda | 16/86 A |
| 4,505,502 | 3/1985 | Tomita | 16/DIG. 17 |
| 4,532,672 | 8/1985 | Anderson | 16/86 A |

*Primary Examiner*—Chuck Y. Mah

*Attorney, Agent, or Firm*—Thorpe, North & Western, L.L.P

[57] ABSTRACT

The present invention is directed to a doorstop whose component parts readily permit the removal and interchange of component parts which are visible. The present invention provides a device which offers its user the ability to readily interchange those visible component parts such that they are compatible with the surrounding decor and which permit such interchange without requiring any special tools, equipment, know-how or technique.

10 Claims, 2 Drawing Sheets

INTERCHANGEABLE DOORSTOP

BACKGROUND

1. The Field of the Invention

The present invention relates to doorstop devices. More particularly, the present invention is directed to a configuration of doorstop which readily permits the attachment and interchange ability of the decorative portion of the doorstop to be compatible with room decor or change in room decor.

2. The Background Art

Many different doorstops have been devised for use in preventing damage to walls caused by the impact of door knobs. As a result, various configurations have attempted to provide a doorstop which is not only aesthetically pleasing, but permanently installed and tamper-proof. As a result, the currently available devices have offered doorstops which attempt to conceal or otherwise secret the manner in which the doorstop is and/or may be attached to or may be removed from the wall or other support surface.

In order to permanently secure door stops to support surfaces, various configurations of currently available doorstops employ a variety of schemes and devices, such as: hooks, latches, lugs, set-screws, the deformation of doorstop members, the nonreversible interlocking of members, nonreusable members, and the nonreversible integration of members. As a result, entire or partial configurations of some doorstops remain, absent destruction or deformation of some component members, unremovably and permanently attached to other members or to the doorstop configuration as a whole.

Other currently available doorstops are designed to provide a device which, in light of its concealed assembly configuration, inhibits the removal of the product absent particularized know-how, techniques, or equipment. The currently available doorstops are designed to be permanent installations inhibiting tampering, vandalism, theft, or any other undesired or unauthorized removal. The currently available devices are also configured to hinder the disassembly of the doorstop, or obtaining of knowledge as to the method of disassembly of the doorstop to anyone other than authorized or knowledgeable persons. As a result, once installed, the currently available doorstops, and their component parts, are generally intended to be permanent fixtures.

The currently available devices do not offer the combination of readily removable and interchangeable doorstop elements adaptable to the decor of the room or to permit compatibility with the variation of decor from room-to-room while also providing a readily separable integral bumper housing securing the position of the cushioning bumper element in the doorstop.

The currently available doorstop devices also require that the cushioning bumper member be specially configured to be compatible with other internal members and that the cushioning bumper provide special operative functions, particularized structural configurations, or be structured in such a manner so as to not inhibit other internal structures or operative features of the doorstops.

In view of the state of the art, what is needed is a doorstop which is economical to produce, does not require special tooling or equipment for installation or removal, a doorstop whose design permits the ready removal or interchange ability of component parts for convenience in making the doorstop compatible with the decor or changing decor in which the doorstop is used, and which doorstop is of such lightweight construction that the installation does not require special fastening mechanisms or equipment.

BRIEF SUMMARY AND OBJECTS OF THE INVENTION

The present invention is directed to doorstops. More particularly, the present invention is directed to doorstops which permit ready installation and removal. The doorstops of the present invention are designed to permit ready and immediate interchange ability of parts in order to be compatible with the immediate decor or change in decor of the space in which they are used, or to permit the doorstops to be compatible with the decor of each space notwithstanding the variability of decor from space-to-space in immediately or connecting rooms or spaces.

The present invention is directed to a doorstop having an interchangeable decorative retaining shield, a cushioning bumper member, and a receiving member. The interchangeable decorative retaining shield is provided with an aperture through which the cushioning member may protrude in order to act as the interface against which the door knob may impact. The interchangeable decorative retaining shield also comprises fastening means compatible with the receiving member so as to permit ready and immediate fastening of the interchangeable shield to and removal from the receiving member. When fastened to the receiving member, the interchangeable retaining shield completely covers and secrets the receiving member and the fastening means.

The cushion bumper is preferably dome-shaped, or the equivalent, so as to protrude through the aperture of the interchangeable retaining shield to function as the impact surface of the doorstop which engages the door knob. The base portion of the cushioning member is configured such that when the interchangeable decorative shield is fastened to the receiving member the base portion of the cushioning bumper is held securely in place and rigidly held between the interchangeable retaining shield and the receiving member.

The receiving member comprises fastening means compatible with and/or adaptable to the fastening means integral with the interchangeable retaining shield. The receiving member has a recess which receives the base portion of the cushion member such that upon fastening of the interchangeable retaining shield to the receiving member the base portion of cushioning bumper is confined between the interchangeable retaining shield and the receiving bracket.

The fastening means may comprise any conventional means which readily permits the assembly or disassembly of the doorstop without the need of any particular tool, preferably with the means not blemishing the aesthetic appearance of the outer or viewable surface of the interchangeable retaining shield. It is preferred that conventional threads function as the fastening means.

The receiving member may be attached to any surface by any suitable means. The preferred embodiment of the invention is made of such light-weight materials that the receiving member may be attached to the respective surface by adhesive means. Mechanical fasteners may also be used where desired or appropriate.

It is therefore an object of the present invention to provide a doorstop which may be readily assembled or disassembled without the necessity of specialized equipment, know-how, or techniques.

Another object of the present invention is to provide a doorstop whose retaining shield, when in place, is not blemished by any mechanisms required to conceal the receiving member but offers an aesthetically pleasing appearance over the unmarred and continuous surface of the entire retaining shield.

Another object of the present invention is to provide a doorstop whose retaining shield may be readily interchanged so as to be compatible with the decor of the space or room in which the doorstop is used.

Still another object of the present invention is to provide a doorstop whose assembly and disassembly do not require deformation, destruction, or reconfiguration of any doorstop component in order to assure the intended operation of the doorstop.

Yet another object of the present invention is to provide a doorstop whose material and construction permit the doorstop to be installed by any conventional means, including adhesion.

Another object of the present invention is to provide a doorstop in which the configuration of the cushioning member may vary to accommodate door knobs with passage locks and wherein such a combination does not require any change in the configuration of the interchangeable retaining shield or the receiving member which is secured to the wall.

BRIEF DESCRIPTION OF THE DRAWINGS

In order that the manner in which the above-recited invention and other advantages and objects of the invention are obtained, a more particular description of the invention briefly described above will be rendered below by reference to a specific embodiment thereof which is illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

The present invention is directed to doorstops. More particularly, the present invention comprises a doorstop which permits the ready and immediate assembly, disassembly, or interchange of the component parts of the doorstop consistent with the decor or change in decor of the room in which the doorstop is used. The configuration of the doorstop of the present invention permits the assembly, disassembly, or interchange of component parts without the use of specialized equipment, techniques, or know-how, and without deforming or otherwise disfiguring doorstop members so as to render the members incapable of being reused.

The doorstop contemplated by the present invention comprises a readily interchangeable, decorative retaining shield, a cushioning bumper, and a receiving member. When assembled, an aperture in the face of the interchangeable retaining shield permits the protrusion of the cushioning bumper while completely encasing the receiving member concealing it from view. The protruding portion of the cushioning bumper acts as the structural interface between the doorstop device and the door knob or handle.

Figure 1:
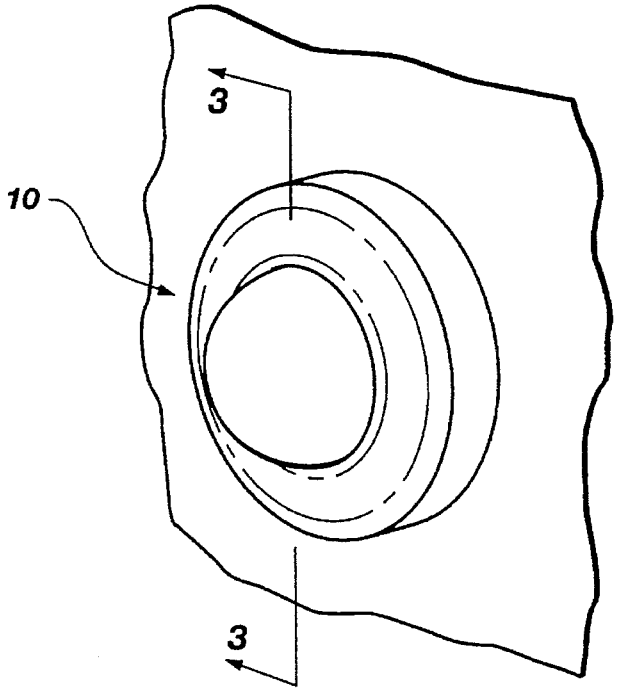
FIG. 1 is a perspective view of one embodiment of a doorstop of the present invention.

The doorstop device 10 is shown in a general perspective view in FIG. 1 installed on a wall and ready to receive the impact of a door knob or a door handle (not represented in the figures). The preferred doorstop 10, shown in FIG. 2, comprises a substantially circular interchangeable decorative retaining shield 20. The retaining shield 20 is provided with an aperture 26 through which a bulb or impact portion 32 of a cushioning bumper 30 protrudes. The receiving member 40 receives the base portion 36 of the cushioning bumper 30 into a recess 48 formed by the perimeter sidewall 46 of the receiving member 40.

The receiving member 40 can receive any one of a number of interchangeable retaining shields, such as interchangeable retaining shield 20, by accepting threads 28 of interchangeable retaining shield 20 which are compatible with threads 42 of the receiving member 40. The receiving member 40 receives the retaining shield 20 viewable to the sidewall 46 so as to completely conceal or hide the receiving member 40 from the casual viewer.

The interchangeable retaining shield 20 comprises a circumferential sidewall portion 24 and a radially inwardly extending face portion 22. Sidewall 24 and face 22 provide an unblemished annular ring or shield which can be treated with a suitable motif which desirably is compatible with the motif of the room in which the doorstop 10 is installed. As a result, the interchangeable retaining shield 20 may be constructed of, or be made to have the appearance of, any material, color, or design compatible with the surrounding decor.

Outer surfaces of the face 22 and sidewall 24 are the viewable surface or surfaces of the interchangeable retaining shield 20. The interior surface of the sidewall 24 is preferably adapted with any suitable and readily removable fastening means which, in conjunction with a compatible fastening means provided on a sidewall 46 of the receiving member 40 (as discussed below), to secure the interchangeable retaining shield 20 to the receiving member 40. It is preferred that conventional threads 28 and 42 be used as a fastening means.

Figure 2:
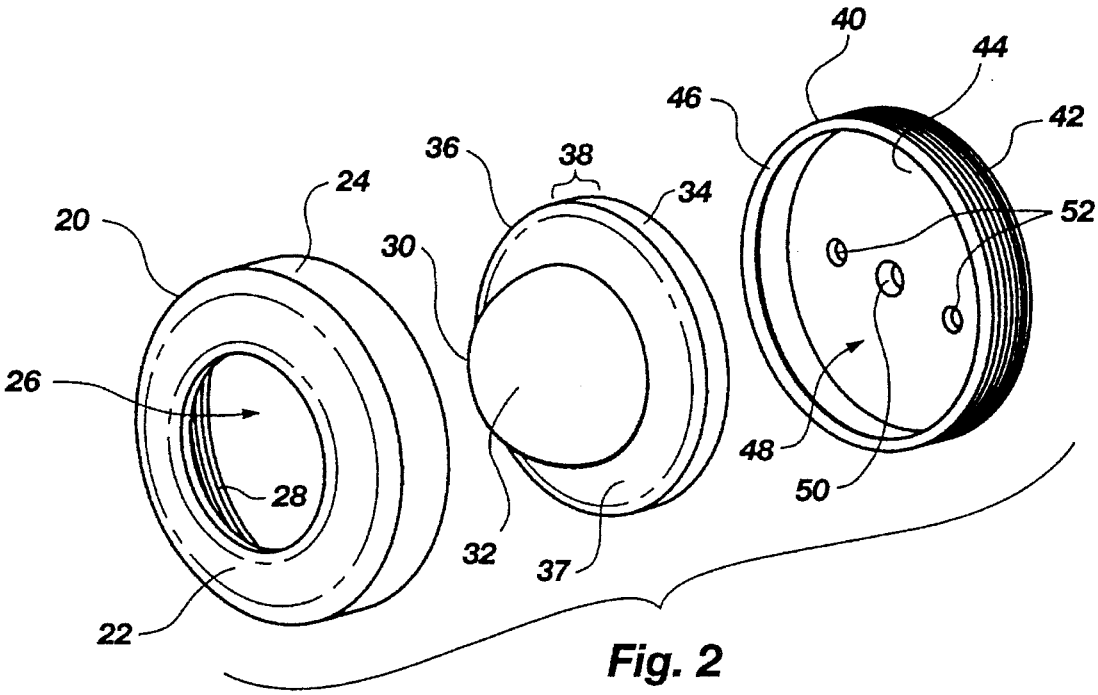
FIG. 2 is an exploded view of one embodiment of the doorstop of the present invention.
Figure 3:
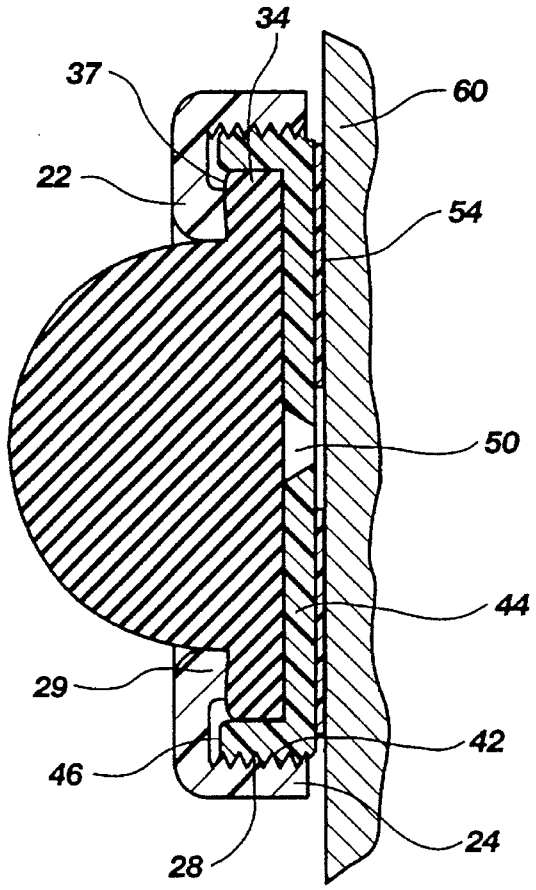
FIG. 3 is a cross-sectional view of one embodiment of the doorstop of the present invention taken along line 3—3 of FIG. 1.

As shown in FIG. 3, the interior surface of the face 22 is configured to include an protruding annular ring 29. The annular ring 29 functions in conjunction with the base portion 36 (see FIG. 2) of cushion bumper 30 as discussed below. The face 22 of the interchangeable retaining shield 20 is also configured annularly such that it extends radially inwardly from the sidewall 24 a predetermined distance such that the aperture 26 (see FIG. 2) is formed.

The cushioning bumper 30 comprises both the bulb or impact portion 32 and the base portion 36. The bulb portion 32 is preferably substantially semi-spherical. The base portion 36 is contiguous to the bulb portion 32 and preferably comprises a flange 34 extending radially outward. It will be appreciated that due to the configuration of the present invention, the cushioning bumper 32 efficiently functions as a doorstop. The cushioning bumper 30 need not be extruded with recesses, gaps, chambers, or any special grooves or the like necessitated by its integral compatibility with other doorstop components, and remains at all times undeformed or otherwise unpunctured, and its structural integrity is not comprised in any other manner.

The cushioning bumper 30 serves as a bumper only. The cushioning bumper 30 does not provide structural support for any other component of the doorstop. As a result, the cushioning bumper 30 is also immediately, readily, and universally interchangeable with another cushioning bumper without the necessity of removing or disassembling any other parts fixed permanently or temporarily to it. Furthermore, no special tool, technique, or particularized know-how is necessary to effectively interchange the cushioning bumper 30.

Figure 4:
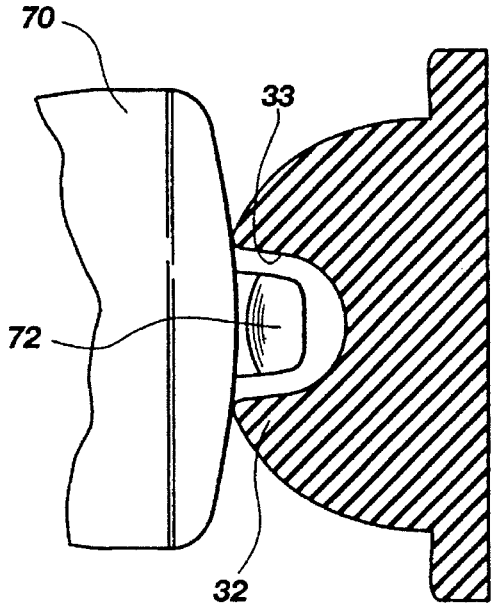
FIG. 4 illustrates another embodiment including a cushioning bumper compatible with door knobs having passage locks.

Referring next to FIG. 4, the cushioning bumper 30 may also be configured to provide a passage lock recess 33 in the impact portion 32 which is compatible with a door knob 70 having a passage lock 72. As a result, the cushioning effect of impact portion 32 desirably does not register against passage lock 72 but against door knob 70.

The cushioning bumper 30 should also be structurally compatible with the interchangeable retaining shield 20 as will now be described. The bulb portion 32 of the cushioning bumper 30 should have a diameter at or near the interface between the bulb portion 32 and the base portion 36 which is compatible with the diameter of the aperture 26 provided in the interchangeable retaining shield 20 such that the bulb portion 32 fits closely within the aperture 26 and protrudes through the aperture 26. In addition, the flange 34 should extend radially outward a sufficient distance such that the protruding annular ring 29 contacts surface 37 of the flange 34 such that decorative retaining shield 20 defines the relative position of cushioning bumper 30, as shown in FIG. 3.

As shown best by reference to both FIGS. 2 and 3, the receiving member 40 comprises a substantially circular base member 44 and a circumferential sidewall 46 at or near the perimeter of the base member 44. The exterior surface of the sidewall 46 is adapted with fastening means such as threads 42 compatible with the threads 28 of the interchangeable retaining shield 20. The sidewall 46 and the base member 44 form a substantially cylindrical recess which receives the base portion 36 of the cushioning bumper 30. While not necessary for the optimum operation of a doorstop embodying the present invention, face member 44 may be provided with an opening 50. The opening 50 is optimally placed in the center of the base member 44. The opening 50 may be used as a means for positioning the receiving member 40 on the wall 60 (FIG. 3), and/or for use in attaching the receiving member 40 to the wall 60 if conventional mechanical fastening means are employed to secure the receiving member 40 to a support surface such as a wall 60. Additionally, openings 52 may be provided to further secure receiving member 40 to a support surface and/or prevent any rotation of receiving member 40. It is preferred to secure the receiving member 40 to a support surface by adhesive means, such as a double sided adhesive patch 54, rather than mechanical fastening means, as depicted in FIG. 3.

The cushioning bumper 30 is also preferably compatible with the receiving member 40 as will now be described. The diameter of base portion 36 of cushioning bumper 30 must be compatible with the diameter of recess 48 such that the base 36 may be received into recess 48 with suitable tolerance. In addition, height 38 (see FIG. 2) of the flange 34 must be such that upon the reception of the base 36 into the recess 48, the annular ring 29 functions as a confining stop adjacent to surface 37 and opposite base member 44 so as to retain or confine the cushioning bumper 30 as best illustrated in FIG. 3.

In accordance with the present invention, the decorative interchangeable retaining shield 20 and the cushioning bumper 30 can be readily removed and interchanged whenever suitable or desired to match the surrounding decor without the need of any particularized tools, know-how or techniques, and without compromising the structural integrity of the interchangeable retaining shield 20 or the cushioning bumper 30 in any fashion so as to render the interchangeable retaining shield 20 or the cushioning bumper 30 unsuitable for reuse.

It will be appreciated that the interchangeable retaining shield 20 does not become integral with the cushioning bumper 30. Similarly, the cushioning bumper 30 does not become integral with the receiving member 40. As a result, the preferred embodiments of the present invention provide doorstop component parts which wholly and effectively function independent of any other structural element and thus can be readily interchanged.

It will be appreciated, therefore, that the interchangeable retaining shield 20 may be made of any appropriate material or be colored in any color or fashion suitable or desirable for the decorative needs of the environs in which the doorstop is used. Similarly, the only limitation on the composition of the cushioning bumper 30 is that the cushioning effect be a desirable one. In addition, the cushioning bumper 30 may be provided in any color suitable to surrounding decor or change its surrounding decor.

It will also be appreciated that while the preferred embodiment contemplates doorstop component parts which in plan view are substantially circular, as illustrated in the drawings, any configuration or design compatible with readily reversible fastening and securing means as heretofore set forth is to be considered within the scope of the present invention.

It will further be appreciated that because of the simplicity and reliability of the doorstop of the present invention the components of the doorstop device are capable of being reused and capable of aesthetically blending with any imaginable decor or change in decor. The embodiments of the present invention require no special tools, techniques, know-how or other apparatus to assemble, install, disassemble, and interchange the operative and decorative components thereof.

The present invention may be embodied in other specific forms without departing from its spirit or essential characteristics. The described embodiments are to be considered in all respect only as illustrative and not restrictive. The scope of the invention, is, therefore, indicated by the appended claims rather than by the foregoing description. All changes which come within the meaning and range of equivalency of the claims are to be embraced within their scope.

What is claimed and desired to be secured by United States Letters Patent is:

1. A decorative doorstop comprising:

a receiving member comprising:

a substantially flat base member and a sidewall, the sidewall projecting substantially perpendicularly from the base member and is located substantially at or near the perimeter of the base member and circumferentially circumscribes the base member forming a recess therewith resulting in an inner wall surface of the sidewall and an outer wall surface of the sidewall being formed, the outer wall surface of the sidewall being provided with a first element of a dual-element fastening means, the sidewall having a depth measured from the base member to a periphery of the sidewall substantially equal to a first depth;

a cushioning bumper comprising:

an impact portion and a base portion, the base portion being compatibly configured so as to be receivable within the recess of the base member; and a retaining shield comprising:

a face portion, the face portion having an aperture therein, and a circumferential sidewall extending from the perimeter of the face portion forming a recess therewith resulting in an inner wall surface of the circumferential sidewall and an outer wall surface of the circumferential sidewall being formed, the depth of the sidewall being at least as great as the first depth, the inner wall surface of the circumferential sidewall being provided with a second element of the dual-element fastening means, the second element of the dual-element fastening means being operably compatible with the first element of the dual-element fastening means, the aperture configured to permit the impact portion of the cushioning bumper to protrude through the aperture of the face portion;

the base portion of the cushioning bumper nested in the recess of the receiving member, and the retaining shield removably attached to the receiving member by the fastening means such that the impact portion of the cushioning bumper protrudes through the aperture of the face portion of the retaining shield, the fastening means being readily reversible such that the retaining shield is selectively and readily removable from and attachable to the receiving member and such that the cushioning bumper can be removed from the retaining shield.

2. A decorative doorstop as defined in claim 1 wherein the reversible means for attaching the retaining shield to the receiving member comprises a means for fastening the retaining shield to the receiving member which does not require the deformation, destruction, or disassembly of integral component parts.

3. A decorative doorstop as defined in claim 1 wherein the receiving member further comprises means for attaching the receiving member to a wall or other surface.

4. A decorative doorstop as defined in claim 3 wherein the attaching means comprises at least one mechanical fastener.

5. A decorative doorstop as defined in claim 4 wherein the mechanical fastener comprises at least one screw.

6. A decorative doorstop as defined in claim 3 wherein the attaching means comprises an adhesive.

7. A decorative doorstop as defined in claim 5 wherein the face portion of the retaining shield presents a color which substantially matches the first color of the environment in which the doorstop is located.

8. A decorative doorstop as defined in claim 1 wherein the fastening means comprises a first set of threads and a second set of threads.

9. A decorative doorstop as defined in claim 1 wherein the cushioning bumper comprises a dome-shaped bumper.

10. A decorative doorstop as defined in claim 1 wherein the cushioning bumper comprises a bumper with a recess in the impact portion formed toward the base portion such that when a doorknob having a passage lock impacts the cushioning bumper, the passage lock mechanism does not act as the impact interface but occupies the recess in the cushioning bumper.

* * * * *